US009439018B2

(12) United States Patent
Shidoji

(10) Patent No.: US 9,439,018 B2
(45) Date of Patent: Sep. 6, 2016

(54) AUDIO DATA PROCESSING DEVICE AND AUDIO DATA PROCESSING METHOD

(71) Applicant: Yamaha Corporation, Hamamatsu-shi, Shizuoka (JP)

(72) Inventor: Hiroomi Shidoji, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 36 days.

(21) Appl. No.: 14/387,796

(22) PCT Filed: Mar. 25, 2013

(86) PCT No.: PCT/JP2013/058548

§ 371 (c)(1),
(2) Date: Sep. 24, 2014

(87) PCT Pub. No.: WO2013/146665

PCT Pub. Date: Oct. 3, 2013

(65) Prior Publication Data

US 2015/0092945 A1 Apr. 2, 2015

(30) Foreign Application Priority Data

Mar. 26, 2012 (JP) ..... 2012-069628

(51) Int. Cl.
*H04S 1/00* (2006.01)
*H04R 3/12* (2006.01)
*H04S 5/02* (2006.01)

(52) U.S. Cl.
CPC . *H04S 1/00* (2013.01); *H04R 3/12* (2013.01); *H04S 5/02* (2013.01); *H04S 2400/07* (2013.01)

(58) Field of Classification Search
None
See application file for complete search history.

(56) References Cited

U.S. PATENT DOCUMENTS

RE38,405 E * 1/2004 Clair, Jr. ..... H04R 5/00 381/79
2004/0213411 A1 10/2004 Sakagami
(Continued)

FOREIGN PATENT DOCUMENTS

JP 2003-264898 A 9/2003
JP 2004-328513 A 11/2004
(Continued)

OTHER PUBLICATIONS

International Search Report (PCT/ISA/210) dated Apr. 23, 2013, with English translation (Three (3) pages).
(Continued)

*Primary Examiner* — Brenda Bernardi
(74) *Attorney, Agent, or Firm* — Crowell & Moring LLP

(57) ABSTRACT

An audio data processing device includes a mixing unit that mixes first audio data and second audio data to generate mixed audio data, a first output unit that outputs, to a first speaker, audio data not having undergone the mixing, a second output unit that outputs, to a second speaker, the mixed audio data generated by the mixing unit, a processor which is provided between a point of branching to the mixing unit and the first output unit or between the mixing unit and the second output unit and adds an acoustic effect, and a delay unit which is provided between the branching point and the first output unit or between the mixing unit and the second output unit and delays the audio data so that a relationship of timing between input, to the first speaker, of the audio data output from the first output unit and input, to the second speaker, of the audio data output from the second output unit coincides with a relationship of timing of input between the first audio data and the second audio data.

12 Claims, 7 Drawing Sheets

(56) References Cited

U.S. PATENT DOCUMENTS

| | | | |
|---|---|---|---|
| 2005/0008171 | A1 | 1/2005 | Hosoi et al. |
| 2005/0265564 | A1 | 12/2005 | Noro |
| 2008/0118078 | A1 | 5/2008 | Asada et al. |
| 2008/0247554 | A1 | 10/2008 | Caffrey |

FOREIGN PATENT DOCUMENTS

| | | | |
|---|---|---|---|
| JP | 2005-27163 | A | 1/2005 |
| JP | 2005-94150 | A | 4/2005 |
| JP | 2005-210504 | A | 8/2005 |
| JP | 2005-341257 | A | 12/2005 |
| JP | 2008-131089 | A | 6/2008 |
| JP | 2011-211728 | A | 10/2011 |

OTHER PUBLICATIONS

Japanese language Written Opinion (PCT/ISA/237) dated Apr. 23, 2013 (Six (6) pages).

Japanese Office Action issued in counterpart Japanese Application No. 2012-069628 dated May 10, 2016 with English translation (nine pages).

* cited by examiner

RELATED ART

AUDIO DATA PROCESSING DEVICE AND AUDIO DATA PROCESSING METHOD

TECHNICAL FIELD

This invention relates to a technology of supplying audio data to a plurality of speakers.

BACKGROUND ART

A speaker system in which sounds of a plurality of channels are emitted from a plurality of speakers, respectively, is frequently used in order to create a desired sound field when the user enjoys acoustic contents or video contents with sound in a sound space.

For example, a 2.1 channel speaker system includes not only a front left speaker (hereinafter, referred to as "Lsp") for emitting mainly the sound of a front left channel (hereinafter, referred to as "Lch") and a front right speaker (hereinafter, referred to as "Rsp") for emitting mainly the sound of a front right channel (hereinafter, referred to as "Rch") used for generating a stereo sound field but also a subwoofer (hereinafter, referred to as "SW") for emitting the sound of a low-pitched channel (hereinafter, referred to as "LFE [low frequency effect] ch") containing large amounts of low frequency band components.

Compared with the Lsp and the Rsp, the SW is a speaker excellent in the capability of emitting sounds in a low frequency band. Moreover, the reason why the speaker system where the SW is added to a two-channel speaker system including the Lsp and the Rsp is called a 2.1 channel speaker system is that since the frequency band where the SW can emit sound is narrow compared with the Lsp and the Rsp and the low frequency band sound emitted from the SW does not have much influence on the localization of the sound in the sound field and is poor in the independence as a channel, it is counted as 0.1.

Moreover, in recent years, for generation of a more natural sound field, a surround sound system having more channels such as 5.1 channels, 7.1 channels or 9.1 channels has been spreading.

As a technology for creating a desired sound field in a multi-channel surround sound system, for example, Patent Document 1 describes a technology where when acoustic contents including no LFEch (for example, five channels) are played back by using a speaker system including the SW (for example, 5.1 channels), in order to eliminate the delay caused with respect to the sounds emitted from the other speakers (main speakers) in the sound emitted from the SW, a delay by a delay unit is added to the pieces of audio data output to the main speakers.

PRIOR ART DOCUMENT

Patent Document

Patent Document 1: JP-A-2005-27163

SUMMARY OF THE INVENTION

Problem that the Invention is to Solve

In recent years, an SW connected wirelessly (connected by radio) to a player has been spreading. Since the SW emits a low frequency band sound that does not have much influence on the listener's sound localization, the location of the SW in the sound space does not have much influence on the sound field. For this reason, there is a need that the SW that tends to be large in size compared with the main speakers be freely placed in an unobtrusive position in the sound space. To meet that need, more and more SWs are mounted with a wireless connection unit.

When audio data transmission by wired connection using a cable is performed from the player to the main speakers and audio data transmission by radio connection using a radio wave is performed from the player to the SW, since the speed of transmission by radio connection is generally lower than the speed of transmission by wired connection, a timing gap is caused between the sounds emitted from the main speakers and the sound emitted from the SW.

It is undesirable that a timing gap be caused between sounds of different channels since it causes the listener discomfort. The timing gap between channels can be eliminated by delaying the timing of audio data output to the main speakers connected by cable. However, in that case, the time from the timing of output from the player to an AV amplifier or the like to when a sound is actually emitted from the speaker is long, and for example, when the acoustic contents include an image, a problem arises in that the sound is played back with a lag from the image displayed on the display.

For example, as the number of channels of surround sound systems increases, a similar problem arises in cases such as when a speaker disposed in a position away from a player and the player are connected wirelessly and when audio data is transmitted to the main speakers connected wirelessly to the AV amplifier incorporated in the subwoofer.

Considering the above-described circumstance, an object of the present invention is to provide a sound field that causes the listener little discomfort, by eliminating the sound timing gap between channels that is caused when pieces of audio data of a plurality of channels are transmitted through transmission paths of different transmission speeds and reducing the time delay from the audio data input to the sound emission compared with the case according to the related art.

Means for Solving the Problem

To solve the above-mentioned problem, the present disclosure provides an audio data processing device provided with; a first input unit that receives input of first audio data representative of a first sound; a second input unit that receives input of second audio data representative of a second sound; a mixing unit that mixes the first audio data and the second audio data to generate mixed audio data; a first output unit that outputs, to a first speaker, audio data being the first audio data and not having undergone the mixing by the mixing unit; a second output unit that outputs, to a second speaker, the mixed audio data generated by the mixing unit; a processor that is provided between a point of branching to the mixing unit and the first output unit on a transmission path between the first input unit and the first output unit, or between the mixing unit and the second output unit, and performs processing of adding an acoustic effect to the audio data; and a delay unit that is provided between the branching point and the first output unit on the transmission path between the first input unit and the first output unit, or between the mixing unit and the second output unit, and delays the audio data so that a relationship of timing between input, to the first speaker, of the audio data output from the first output unit and input, to the second speaker, of the audio data output from the second output unit coincides with a relationship of timing of input between the first audio data at the first input unit and the second audio data at the second input unit.

For example, the audio data processing device is provided with: a third output unit that outputs, to a third speaker, audio data being the second audio data and not having undergone the mixing by the mixing unit; an other processor that is provided between an other point of branching to the mixing unit and the third output unit on a transmission path between the second input unit and the third output unit, and performs processing of adding an acoustic effect to the audio data; and an other delay unit that is provided between the other branching point between the second input unit and the third output unit, and the third output unit, and delays the audio data so that a relationship of timing between input, to the third speaker, of the audio data output from the third output unit and input, to the second speaker, of the audio data output from the second output unit coincides with the relationship of timing of input between the first audio data at the first input unit and the second audio data at the second input unit.

For example, a transmission speed of an audio data transmission path from the second output unit to the second speaker is lower than a transmission speed of an audio data transmission path from the first output unit to the first speaker, and the processor is provided between the branching point and the first output unit on the transmission path between the first input unit and the first output unit.

For example, the audio data transmission path from the second output unit to the second speaker is a radio transmission path.

For example, a transmission speed of an audio data transmission path from the first output unit to the first speaker is lower than a transmission speed of an audio data transmission path from the second output unit and the second speaker, and the processor is provided between the mixing unit and the second output unit.

For example, the audio data transmission path from the first output unit to the first speaker is a radio transmission path.

For example, when processing contents of the processor are changed, a delay time set for the delay unit is changed based on a processing time required for the processing of the changed processing contents.

Moreover, the present disclosure provides an audio data processing method provided with: a first reception step of receiving input of first audio data representative of a first sound by a first input unit; a second reception step of receiving input of second audio data representative of a second sound by a second input unit; a mixing step of mixing the first audio data and the second audio data by a mixing unit to generate mixed audio data; a first output step of outputting audio data being the first audio data and not having undergone the mixing, to a first speaker by a first output unit; a second output step of outputting the mixed audio data generated by the mixing step, to a second speaker by a second output unit; a processing step of performing processing of adding an acoustic effect to the audio data by a processor provided between a point of branching to the mixing unit and the first output unit on a transmission path between the first input unit and the first output unit, or between the mixing unit and the second output unit; and a delay step of delaying the audio data so that a relationship of timing between input, to the first speaker, of the audio data output from the first output unit and input, to the second speaker, of the audio data output from the second output unit coincides with a relationship of timing of input between the first audio data at the first input unit and the second audio data at the second input unit, by a delay unit provided between the branching point and the first output unit on the transmission path between the first input unit and the first output unit, or between the mixing unit and the second output unit.

For example, the audio data processing method is provided with: a third output step of outputting audio data being the second audio data and not having undergone the mixing by the mixing unit, to a third speaker by a third output unit; a processing step of performing processing of adding an acoustic effect to the audio data by an other processor provided between an other point of branching to the mixing unit and the third output unit on a transmission path between the second input unit and the third output unit; and a delay step of delaying the audio data so that a relationship of timing between input, to the third speaker, of the audio data output from the third output unit and input, to the second speaker, of the audio data output from the second output unit coincides with the relationship of timing of input between the first audio data at the first input unit and the second audio data at the second input unit, by an other delay unit provided between the other branching point between the second input unit and the third output unit, and the third output unit.

For example, a transmission speed of an audio data transmission path from the second output unit to the second speaker is lower than a transmission speed of an audio data transmission path from the first output unit to the first speaker, and the processor is provided between the branching point and the first output unit on the transmission path between the first input unit and the first output unit.

For example, the audio data transmission path from the second output unit to the second speaker is a radio transmission path.

For example, a transmission speed of an audio data transmission path from the first output unit to the first speaker is lower than a transmission speed of an audio data transmission path from the second output unit and the second speaker, and the processor is provided between the mixing unit and the second output unit.

For example, the audio data transmission path from the first output unit to the first speaker is a radio transmission path.

For example, when processing contents of the processor are changed, a delay time set for the delay unit is changed based on a processing time required for the processing of the changed processing contents.

MODE FOR CARRYING OUT THE INVENTION

Related Art

Prior to describing a surround sound system according to an embodiment of the present invention, a sound system 9 according to a related art will be described first by using FIG. 7.

Figure 7:
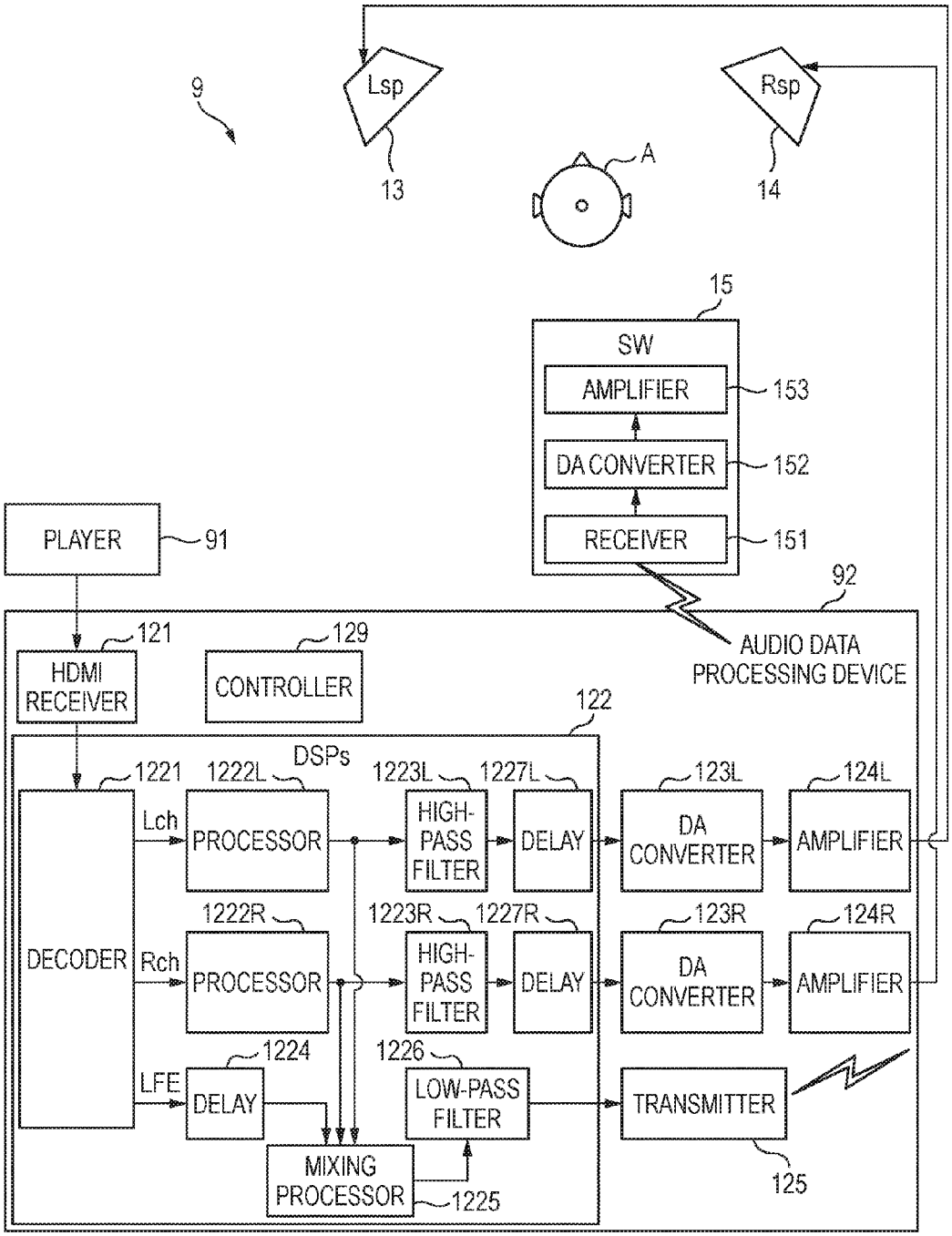
FIG. 7 A view showing the structure of a sound system according to a related art.

In the sound system 9 shown in FIG. 7, a player 91 successively reads, from a recording medium, acoustic data representative of 2.1 channel acoustic contents to be played back in a sound space where the sound system 9 is placed, and outputs the acoustic data to an audio data processing device 92 in a format conforming to the HDMI (High-Definition Multimedia Interface) (trademark) standard.

An HDMI receiver 121 possessed by the audio data processing device 92 receives the acoustic data input from the player 91, and passes it to DSPs 122 possessed by the audio data processing device 92.

The DSPs 122 function as various functional units that process the audio data of a decoder 1221 or the like under the control of a controller 129.

The decoder 1221 decodes the acoustic data passed from the HDMI receiver 121 to generate pieces of audio data of 2.1 channels, that is, three channels of the Lch, the Rch and the LFEch. The decoder 1221 passes the pieces of audio data of the Lch and the Rch to a processor 1222L and a processor 1222R, respectively.

The processor 1222L and the processor 1222R perform processing for adding various acoustic effects to the sounds of the Lch and the Rch such as FIR (Finite Impulse Response) filter processing.

The pieces of audio data to which various acoustic effects have been added by the processor 1222L and the processor 1222R are passed to a high-pass filter 1223L and a high-pass filter 1223R. The high-pass filter 1223L and the high-pass filter 1223R are high-pass filters with a cut-off frequency of, for example, 500 Hz, and generate audio data where the components in the frequency band of not more than the cut-off frequency are attenuated.

Moreover, the decoder 1221 passes, to a delay unit 1224, the audio data of the LFEch generated by decoding the acoustic data passed from the HDMI receiver 121. The delay unit 1224 delays the passing of the audio data of the LFEch to a mixing processor 1225 by the delay time caused when the processor 1222L and the processor 1222R process the pieces of audio data of the Lch and the Rch.

The processor 1222L and the processor 1222R pass the pieces of audio data of the Lch and the Rch to which acoustic effects have been added, to the high-pass filter 1223L and the high-pass filter 1223R as described above, and at the same time, pass the pieces of audio data of the Lch and the Rch to which acoustic effects have been added, also to the mixing processor 1225. Moreover, the delay unit 1224 passes the audio data of the LFE passed from the decoder 1221, to the mixing processor 1225 after the elapse of the above-mentioned delay time.

The mixing processor 1225 mixes the pieces of audio data of the Lch, the Rch and the LFE received from the processor 1222L, the processor 1222R and the delay unit 1224 to generate mixed audio data.

The reason why the timing of passing of the audio data of the LFE to the mixing processor 1225 is delayed by the delay unit 1224 by the time required for the acoustic effect addition processing by the processor 1222L and the processor 1222R is in order to prevent the relationship of timing between the sounds of the different channels represented by the pieces of audio data to be mixed from shifting from the relationship of timing between the sounds represented by the pieces of audio data contained in the acoustic data obtained by the HDMI receiver 121 from the player 91 (hereinafter, referred to as "original timing relationship"). Therefore, the delay time of the delay unit 1224 varies according to the time required for the processing by the processor 1222L and the processor 1222R.

Moreover, the purpose of mixing the audio data of the Lch and the Rch with the audio data of the LEE by the mixing processor 1225 is to generate audio data for causing an SW 15 to emit the sound of, of the components contained in the sounds of the Lch and the Rch, the components of not more than 500 Hz that an Lsp 13 and an Rsp 14 cannot sufficiently emit.

The processing of mixing pieces of audio data so as to cause the woofer to emit the sound of low frequency band components that are difficult for the main speakers to emit as mentioned above is called bus management. In the bus management, it is necessary that the relationship of timing between the pieces of audio data of different channels to be mixed be made the original timing relationship in the mixing processing. The delay unit 1224 is provided for that purpose.

The bus management as described above is required because main speakers have been miniaturized in recent years. For example, as liquid crystal televisions are becoming thinner and larger in screen size, it is preferred that main speakers incorporated in liquid crystal televisions or disposed below racks or the like where liquid crystal televisions are placed be small in size because of space limitations.

The miniaturization of speakers reduces the speakers capability of emitting low frequency band sounds. For this reason, as main speakers that should originally take charge of emitting sounds in a frequency band of not less than 100 Hz are miniaturized, a situation occurs in which only the sounds in a frequency band of, for example, not less than 500 Hz can be sufficiently emitted.

On the other hand, the audio data for the main speakers contained in the acoustic data played back at a speaker system contains components in a frequency band of not less than 100 Hz. This is because it is desirable that sounds in the frequency band of not less than 100 Hz be emitted from the main speakers placed in appropriate positions since general listeners can feel localization of sounds in the frequency band of approximately not less than 100 Hz.

Therefore, when miniaturized main speakers are used, a problem arises in that sounds in a frequency band of, for example, 100 Hz to 500 Hz are not sufficiently emitted from the main speakers. Therefore, the pieces of audio data for the main speakers are mixed with the audio data for the SW and low frequency components are extracted by a low-pass filter and output to the SW, thereby avoiding the lack of the sound in the frequency band of 100 Hz to 500 Hz. The bus management is mixing processing and frequency band separation processing required therefor.

Returning to FIG. 7, description of the sound system 9 will be continued. The mixing processor 1225 passes the generated mixed audio data to a low-pass filter 1226. The low-pass filter 1226 is a low-pass filter with a cut-off frequency of, for example, 500 Hz, and generates audio data where the components in the frequency band of not less than the cut-off frequency are attenuated. The order of the low-pass filter 1226 is the same as the orders of the high-pass filter 1223L and the high-pass filter 1223R, and the delay times accompanying the processings of these filters are the same. For this reason, no timing gap between the channels is caused by these filter processings.

The pieces of audio data of the Lch and the Rch processed by the DSPs 122 as described above are passed from the high-pass filter 1223L and the high-pass filter 1223R to a delay unit 1227L and a delay unit 1227R, respectively. The delay unit 1227L and the delay unit 1227R delay the output timings of the pieces of audio data form the audio data processing device 92 to the Lsp 13 and the Rsp 14 by the difference in transmission time between the transmission paths of the audio data from the audio data processing device 92 to the Lsp 13 and the Rsp 14 (wired data communication path) and the transmission path of the audio data from the audio data processing device 92 to the SW 15 (radio data communication path). The delay time of the delay unit 1227 does not change as a rule.

The delay unit 1227L and the delay unit 1227R delay the output timings as described above, and pass the pieces of audio data to a DA converter 123L and a DA converter 123R, respectively. The DA converter 123 converts the passed pieces of audio data (digital data) into pieces of analog audio data, and outputs them to an amplifier 124L and an amplifier 124R.

The amplifier 124L and the amplifier 124R amplify the pieces of audio data input from the DA converter 123 to a speaker driving level and then, output them to the Lsp 13 and the Rsp 14 connected to the audio data processing device 92 by cable, respectively. The Lsp 13 and the Rsp 14 emit the sounds of the Lch and the Rch into the sound space according to the pieces of audio data input from the audio data processing device 92. The Lsp 13 and the Rsp 14 are small-size speakers, and poor in the capability of emitting sounds of not more than 500 Hz.

On the other hand, the mixed audio data processed by the DSPs 122 is passed from the low-pass filter 1226 to a transmitter 125. The transmitter 125 transmits the passed mixed audio data to the SW 15 via radio waves.

The SW 15 is large in size compared with the Lsp 13 and the Rsp 14, and excellent in the capability of emitting sounds in a low frequency band including the frequency band of not more than 500 Hz. The SW 15 is provided with a receiver 151, and receives the mixed audio data transmitted by radio from the transmitter 125 of the audio data processing device 92.

The receiver 151 passes the received mixed audio data to a DA converter 152. The DA converter 123 converts the passed mixed audio data (digital data) into analog audio data, and outputs it to an amplifier 153. The amplifier 153 amplifies the audio data input from the DA converter 152 to a speaker driving level. According to the audio data amplifier by the amplifier 153, the sound of the LFE mixed with the low frequency band components of the sounds of the Lch and the Rch is emitted into the sound space.

The sounds emitted from the Lsp 13, the Rsp 14 and the SW 15 reach a listener A in the original timing relationship by the delay processing for timing adjustment by the delay unit 1227L and the delay unit 1227R. As a result, the listener A can comfortably enjoy the acoustic contents played back by the player 91 without perceiving a sound emission timing gap between the sounds emitted from the main speakers and the sound emitted from the subwoofer.

However, in the case according to the sound system 9, the time lag from the input of the audio data from the player 91 to the emission of the sound into the sound space is long. This is because the following delay times accompany: the delay time of the delay unit 1224 for adjusting the timing of the audio data input to the mixing processor 1225 and the delay time by the delay unit 1227L and the delay unit 1227R for eliminating the timing gap by the times of audio data transmission to the main speakers 13 and 14 (connected by cable) and the subwoofer SW (connected by radio). Therefore, although no significant problem accompanies when only acoustic contents are played back, the following problems arise, for example, when the sound system 9 is used for playing back acoustic contents with image (AV contents):

The first one is a problem in that a timing gap is caused between the image and the sound. Many players do not have the function of delaying the output of the video signal in order that image display is timed to sound emission. In that case, a situation sometimes occurs in which the listener A perceives a delay of the sound from the image and cannot enjoy the AV contents with comfort.

Moreover, some players have a function called lip-sync, and are capable of reducing the time lag between the display timing and the emission timing of the image and the sound contained in the same AV contents by delaying the output timing of either the video signal or the sound signal. However, even in that case, when display and sound emission are performed of AV contents of an interactive and realtimeness-oriented game such as a game using sounds and a competition type game, if a time lag to the extent recognized by the user is caused between the timing of an operation by the user and the timing of display and sound emission as the response to the operation, the user cannot enjoy the AV contents with comfort after all. For this reason, it is necessary to minimize the delay in the audio data processing device.

First Embodiment

Subsequently, an AV system 1 according to a first embodiment of the present invention will be described. Like the sound system 9, the AV system 1 has its structure improved so that the timing gap between the sounds of different channels is prevented from being caused and that the system delay accompanying the playback of acoustic contents is short.

Figure 1:
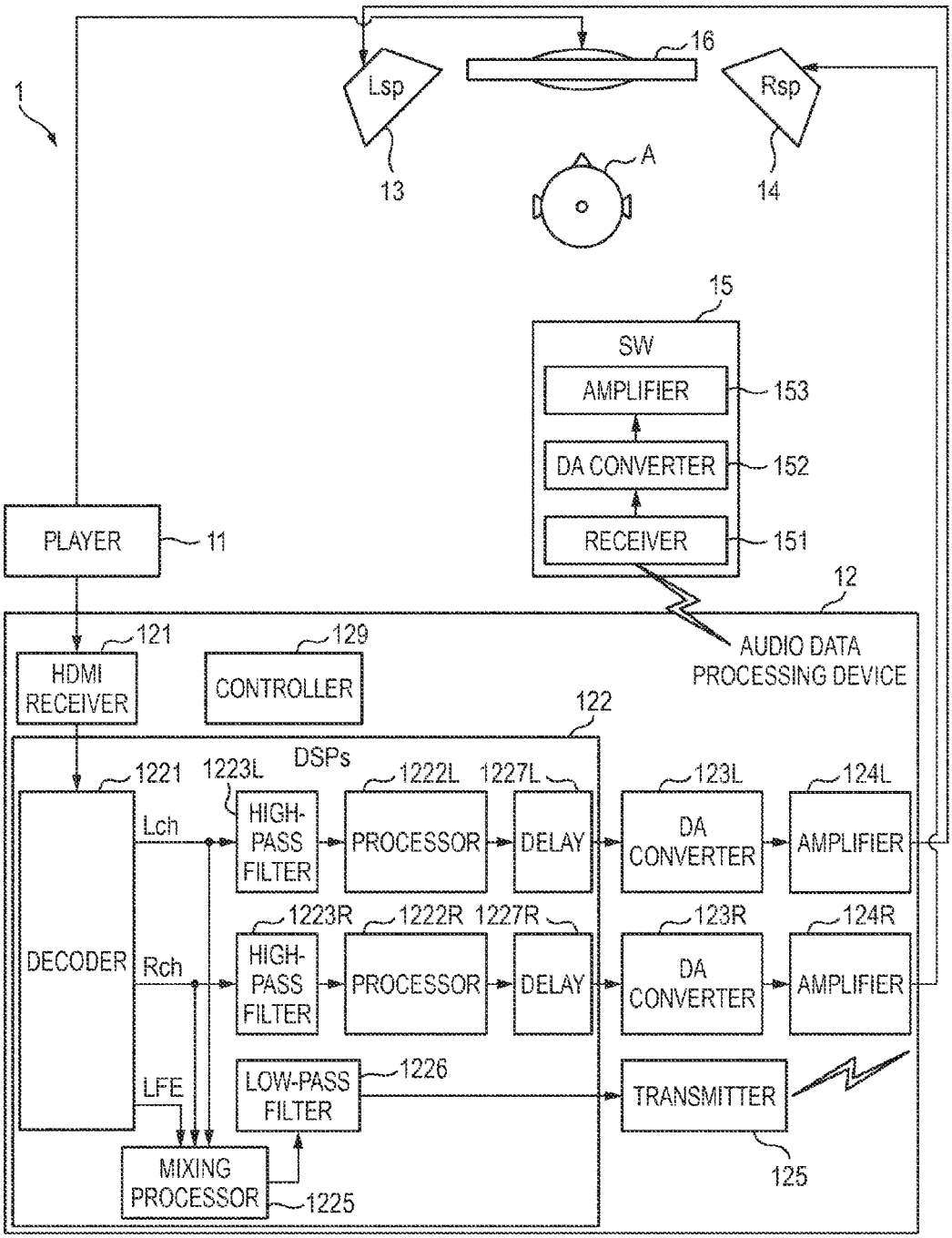
FIG. 1 A view showing the structure of an AV system according to a first embodiment.

FIG. 1 is a view showing the structure of the AV system 1. In FIG. 1, elements common to those of the sound system 9 are denoted by the same reference numerals.

In an audio data processing device 12 of the AV system 1, the processor 1222L and the processor 1222R are not disposed in positions in the audio data processing device 92, that is, on the transmission paths of the pieces of audio data of the Lch and the Rch from the decoder 1221 toward the mixing processor 1225 but disposed on the transmission paths of the pieces of audio data from the point of audio data branching to the mixing processor 1225 toward the Lsp 13 and the Rsp 14.

That is, in the example shown in FIG. 1, the processor 1222L is disposed on the downstream side of the high-pass filter 1223L on the transmission path, and the processor 1222R is disposed on the downstream side of the high-pass filter 1223R on the transmission path.

Here, the processor 1222L and the processor 1222R perform the processing of adding acoustic effects that are highly effective for the sounds emitted from the Lsp 13 and the Rsp 14 and less effective for the sounds emitted from the SW 15. For this reason, even though the processor 1222L and the processor 1222R are disposed on the downstream side of the point of branching to the mixing processor 1225, this hardly affects the sound field realized by the AV system 1.

Comparing with the audio data processing device 92 of FIG. 7, the audio data processing device 12 is not provided with the delay unit 1224. The reason therefor is as follows:

If the sound system 9 is not provided with the delay unit 1224, the pieces of audio data of the Lch and the Rch are input to the mixing processor 1225 with a lag of the time required for the acoustic effect addition processing by the processor 1222L and the processor 1222R from the audio data of the LFEch not having undergone such acoustic effect addition processing. However, for the mixing processor 1225, there is a condition that the timing of the audio data of each channel coincides with the original timing relationship. Therefore, the delay unit 1224 performs delay processing on the audio data of the LFEch so that the audio data of the LFEch is input to the mixing processor 1225 in the original timing relationship with the pieces of audio data of the Lch and the Rch. The delay unit 1224 is provided for that purpose.

On the contrary, in the AV system 1, the pieces of audio data of the Lch and the Rch before input to the mixing processor 1225 have not undergone the acoustic effect addition processing by the processor 1222L and the processor 1222R, no delay from the audio data of the LFEch is caused in the pieces of audio data of the Lch and the Rch input to the mixing processor 1225. Therefore, the delay unit 1224 is unnecessary.

Since the structure as described above is provided, the delay time that the AV system 1 requires from the playback processing by a player 11 to the actual sound emission from the Lsp 13, the Rsp 14 and the SW 15 is short compared with the delay time in the sound system 9. This is because in the present embodiment, the delay by the delay unit 1224 is unnecessary and part of the delay time by the radio transmission of the audio data from the transmitter 125 to the receiver 151 is offset by the delay time caused by the acoustic effect addition processing by the processor 1222L and the processor 1222R.

Description will be given below by using a concrete example. For example, it is assumed that the delay time accompanying the processing by the processor 1222L and the processor 1222R is 30 milliseconds and the delay time caused by the radio transmission of the audio data from the transmitter 125 to the receiver 151 is 50 milliseconds.

In the case according to the audio data processing device 92 shown in FIG. 7, under the above-mentioned condition, the delay time of the delay unit 1224 is 30 milliseconds which are the same as the delay time accompanying the processing by the processor 1222L and the processor 1222R, and the delay time of the delay unit 1227 is 50 milliseconds which are the same as the delay time accompanying the radio transmission. Therefore, the sum total of the delay times required for the sound system 9 to compensate for the timing gap between the channels is 80 milliseconds.

On the other hand, in the case according to the audio data processing device 12 of the first embodiment of the present invention shown in FIG. 1, under the above-mentioned condition, the delay time of the delay unit 1227 can be made 20 milliseconds which is the difference when 30 milliseconds which are the delay time by the processing by the processor 1222L and the processor 1222R are subtracted from 50 milliseconds which are the delay time caused by the radio transmission. Since the delay unit 1224 is unnecessary in the AV system 1, the sum total of the delay times required for the AV system 1 to compensate for the timing gap between the channels is 20 milliseconds. The reason why the delay time required to compensate for the timing gap between the channels in the AV system 1 is short compared with the delay time required to compensate for the timing gap between the channels in the sound system 9 as described above is that part (30 milliseconds) of the delay time (50 milliseconds) accompanying the radio transmission of the audio data output to the SW 15 is offset by the delay time (30 milliseconds) accompanying the processing by the processor 1222L and the processor 1222R performed for the pieces of audio data output to the Lsp and the Rsp.

In this case, since the structure of the audio data processing device 92 according to the related art and the structure of the audio data processing device 12 according to the first embodiment of the present invention are similar to each other except for the above-described respect, the overall delay time (50 milliseconds) of the system required for the AV system 1 to emit the sound is 30 milliseconds shorter than the overall delay time (80 milliseconds) of the system required for the sound system 9 to emit the sound.

Moreover, the AV system 1 is provided with a display 16. The player 11 of the AV system 1 is capable of playing back video contents with sound, and outputs video data to the display 16, for example, through an HDMI cable. The display 16 performs image display according to the video data input from the player 11.

In the audio data processing device 12, the processor 1222L and the processor 1222R perform various different processings under the control of the controller 129, for example, according to a user operation. Examples of the processings performed by the processor 1222L and the processor 1222R include the processing of adding acoustic effects such as a cinema mode, a music mode and a night mode to the audio data.

If the contents of the processing performed by the processor 1222L and the processor 1222R change, the delay time required for the processing change as a natural result. When instructing the processor 1222L and the processor 1222R to change the processing contents, the controller 129 indicates the time which is the difference when the delay time required for the processing by the processor 1222L and the processor 1222R after the change is subtracted from the delay time required for the radio transmission, to the delay unit 1227L and the delay unit 1227R as the new delay time. As a result, even if the contents of the processing by the processor 1222L and the processor 1222R are changed, no timing gap is caused between the sounds emitted from the Lsp and the Rsp and the sound emitted from the SW 15.

Second Embodiment

Subsequently, an AV system 2 according to a second embodiment of the present invention will be described. The AV system 2 is the AV system 1 to which a structure that enables lip-sync processing is added.

Figure 2:
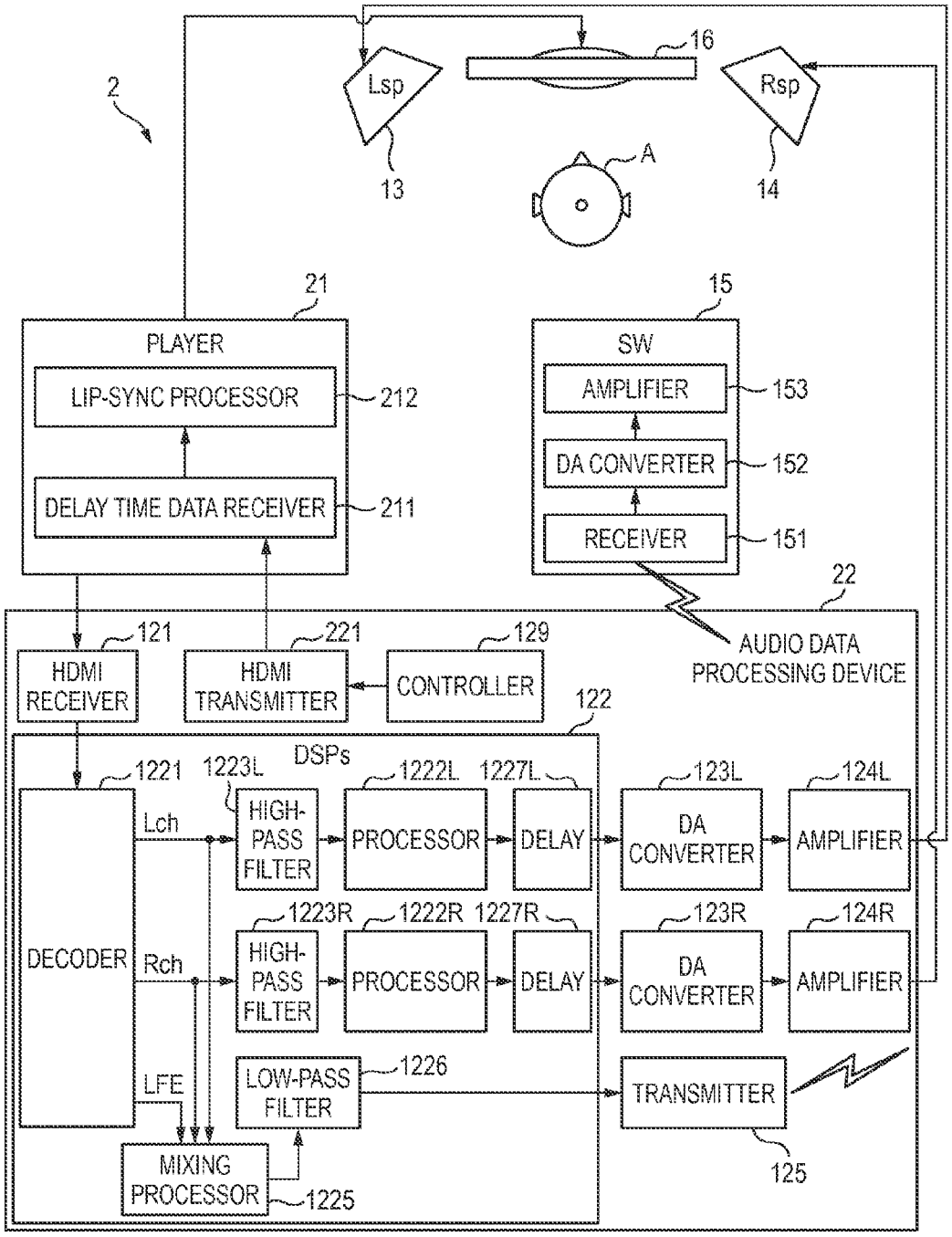
FIG. 2 A view showing the structure of an AV system according to a second embodiment.

As shown in FIG. 2, an audio data processing device 22 of the AV system 2 is provided with an HDMI transmitter 221 (delay time data transmitter) that transmits to a player 21 delay time data representative of the delay time required for the audio data processing device 22 to emit the sound.

Moreover, the player 21 of the AV system 2 is provided with a delay time data receiver 211 that receives the delay time data transmitted from the audio data processing device 22, and a lip-sync processor 212.

The lip-sync processor 212 delays the timing of video data transmission to the display 16 by the delay time represented by the delay time data received by the delay time data receiver 211, thereby making the relationship between the timing of image display by the display 16 and the timing of sound emission by the Lsp 13, the Rsp 14 and the SW 15 coincide with the original timing.

As in the audio data processing device 12, in the audio data processing device 22, for example, according to a user operation, the processor 1222L and the processor 1222R perform different processings under the control of the controller 129 to thereby generate pieces of audio data to which different acoustic effects such as the cinema mode, the music mode and the night mode are added.

When making a mode change, the controller 129 generates delay time data representative of the system delay time in the audio data processing device 22 in accordance with the mode after the change, and passes it to the HDMI transmitter 221. The HDMI transmitter 221 transmits the delay time data passed from the controller 129 in that manner, to the player 21. As a result, even if the mode related to acoustic effects in the audio data processing device 22 is changed, the player 21 can perform the lip-sync processing with an appropriate delay time.

Even in a case where the disposition of the processor 1222L and the processor 1222R in the AV system 2 is replaced with the disposition of the processor 1222L and the processor 1222R in the sound system 9 and the delay unit 1224 is provided, no gap is caused between the image and the sound because of the lip-sync function. However, the delay time is increased that is required from the timing of output of the acoustic data and the video data from the player 21 to the sound emission and the image display. Therefore, for watching of realtimeness-oriented contents such as interactive game contents, the structure of the AV system 2 shown in FIG. 2 is preferable.

Modifications

The above-described embodiments are a concrete example of the present invention, and may be modified variously. Examples of such modifications will be shown below.

The above-described embodiments adopt a structure in which a radio data communication path is used as the transmission path to transmit the mixed audio data to the SW 15, a wired data communication path is used as the transmission path to transmit the pieces of audio data of the Lch and the Rch to the Lsp 13 and the Rsp 14 and the former is accompanied by a longer delay time than the latter.

On the contrary, for example, a structure may be adopted in which a wired data communication path is used as the transmission path to transmit the mixed audio data to the SW 15, a radio data communication path is used as the transmission path to transmit the pieces of audio data of the Lch and the Rch to the Lsp 13 and the Rsp 14 and the latter is accompanied by a longer delay time than the former.

Figure 3:
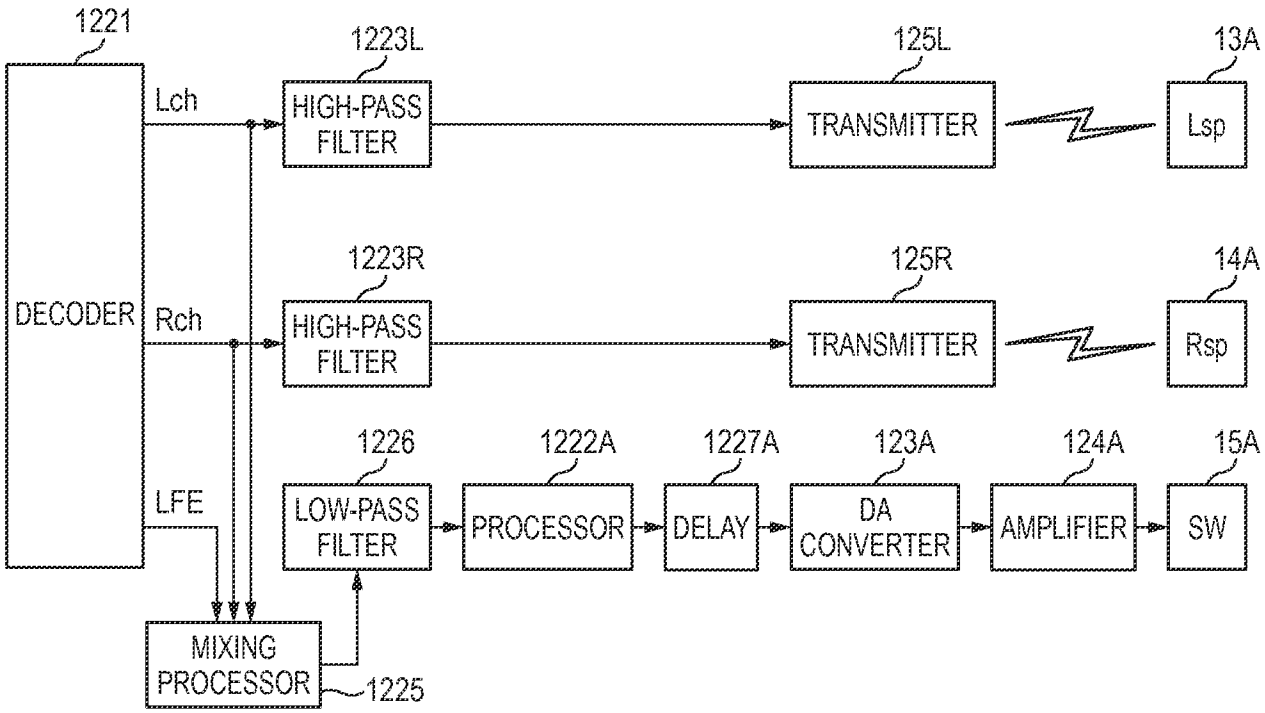
FIG. 3 A view showing part of the functional structure of an audio data processing device according to a modification.

FIG. 3 is a view showing part of the functional structure of an audio data processing device in such a modification. In this modification, the pieces of audio data of the Lch and the Rch are transmitted to an Lsp 13A and an Rsp 14A connected wirelessly to the audio data processing device through a radio transmission path. The mixed audio data is transmitted to the SW 15A through a wired transmission path.

Moreover, in this modification, a processor 1222A corresponding to the processor 1222L and the processor 1222R is disposed on the transmission path through which the mixed audio data is transmitted from the mixing processor 1225 to the SW 15A. This processor 1222A is, for example, a high-pass filter, and is provided for realizing a desired sound field with little distortion by attenuating the components in an ultralow frequency band (for example, not more than 40 Hz, a band where even the SW is insufficient in sound emission capability) contained in the mixed audio data.

Moreover, in this modification, a delay unit 1227A corresponding to the delay unit 1227 is provided on the transmission path through which the mixed audio data is transmitted from the mixing processor 1225 to the SW 15A.

When the speed of transmission of the mixed audio data to the SW 15A on the wired transmission path is higher than the speed of transmission of the pieces of unmixed audio data to the Lsp 13A and the Rsp 14A on the radio transmission paths as in this modification, the overall delay time can be reduced by disposing the processor 1222A accompanied by a comparatively long processing delay time on the transmission path with the higher transmission speed (on the downstream side of the point of branching to the mixing processing).

Moreover, while the above-described embodiments adopt a structure in which the delay unit 1227L and the delay unit 1227R for avoiding the timing gap between the channels are disposed on the transmission paths with a high transmission speed, the position of disposition of the delay units is not limited thereto.

Figure 4:
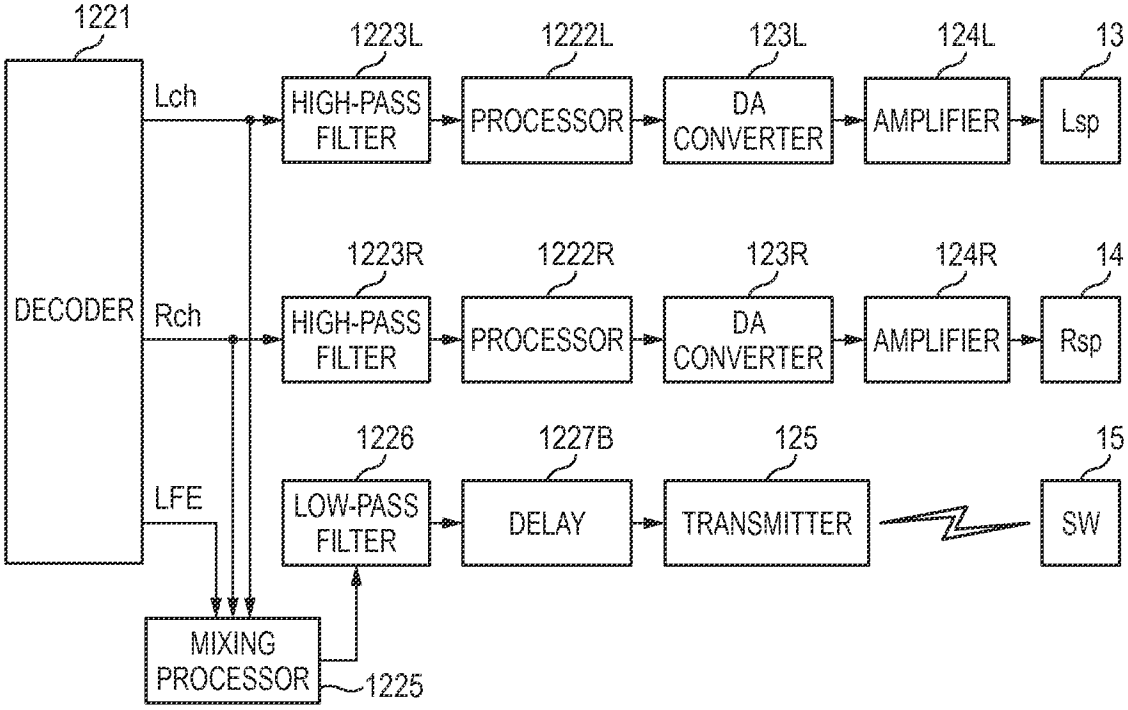
FIG. 4 A view showing part of the functional structure of an audio data processing device according to a modification.

FIG. 4 is a view showing part of the functional structure of an audio data processing device in an example of a modification where a delay unit is disposed on a transmission path with a low transmission speed. Specifically, when the processing delay times at the processor 1222L and the processor 1222R exceed the difference in transmission time between the transmission paths, the timing gap between the channels can be avoided by disposing a delay unit 1227B on the transmission path with the low transmission speed.

Figure 5:
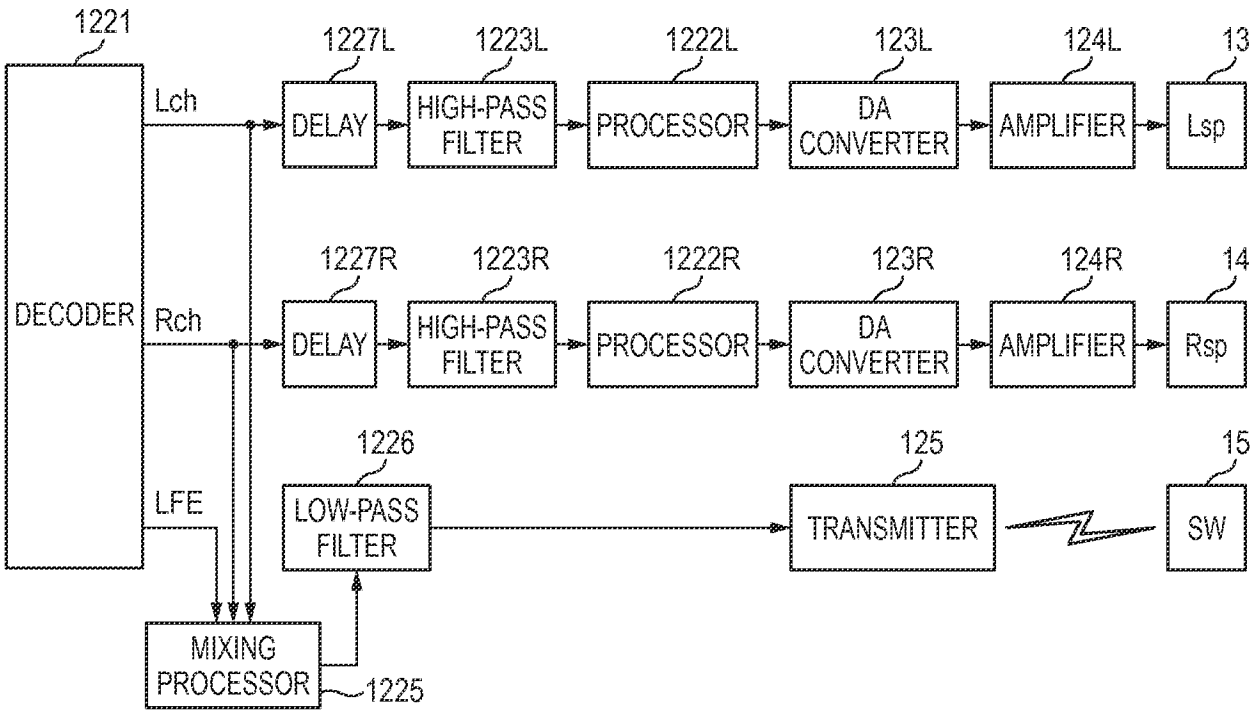
FIG. 5 A view showing part of the functional structure of an audio data processing device according to a modification.

While the delay unit 1227 is disposed on the downstream side of the high-pass filter 1223 in the above-described embodiments, the position of disposition of the delay unit 1227 may be any position that is on the downstream side of the point of branching to the mixing processor 1225 on the transmission path from the decoder 1221 to the Lsp 13 and the Rsp 14. FIG. 5 is a view showing part of the functional structure of an audio data processing device in an example of such a modification. That is, in this example, the delay units 1227L and 1227R are disposed on the side downstream of the point of branching to the mixing processor 1225 and upstream of the high-pass filters 1223L and 1223R.

Figure 6:
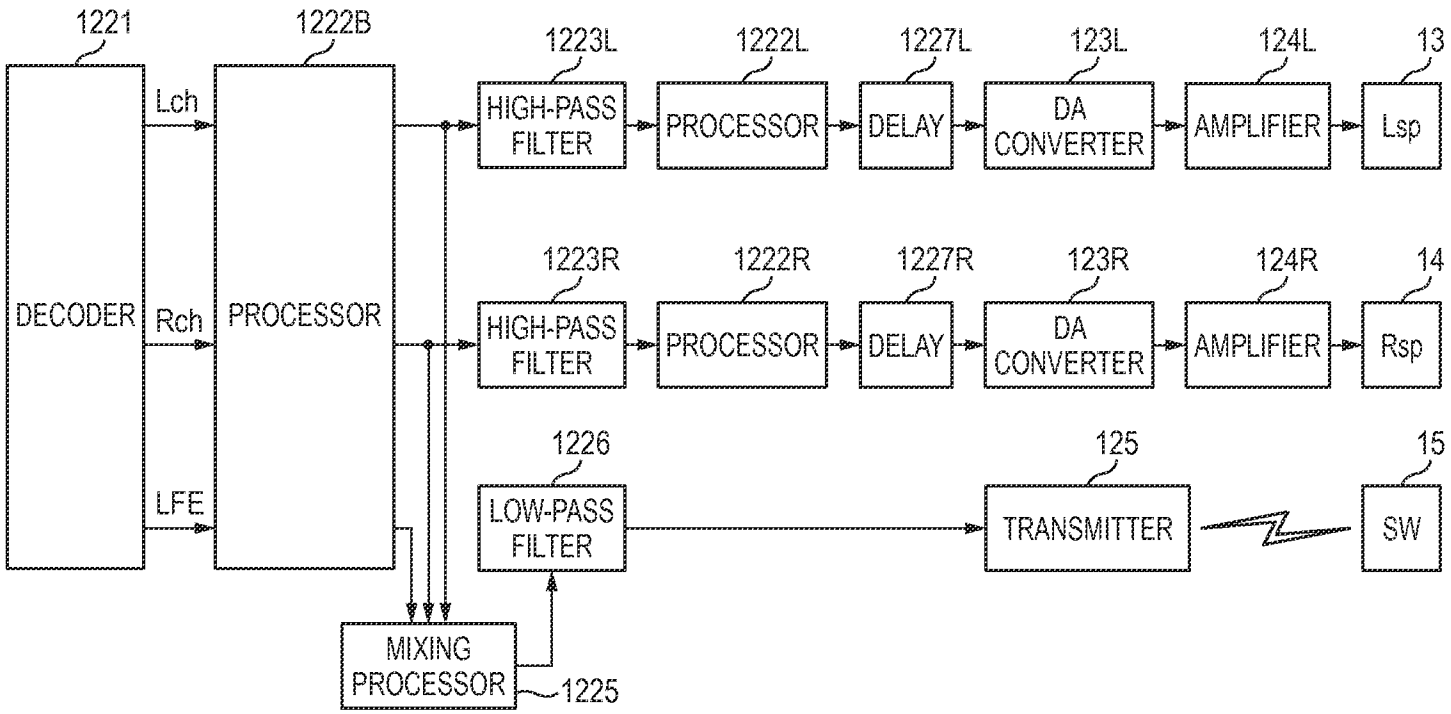
FIG. 6 A view showing the structure of an audio data processing device according to a modification.

While in the above-described embodiments and modifications thereof, the audio data input to and mixed by the mixing processor 1225 is the very audio data that is input from the player 11 to the audio data processing device 12 and decoded by the decoder 1221, the audio data input to the mixing processor 1225 may be new audio data which is the audio data input to the audio data processing device 12 which audio data is generated by a processor 1222B. FIG. 6 is a view showing part of the functional structure of an audio data processing device in an example of such a modification.

While the above-described embodiments adopt a structure in which the mixing processor 1225 performs audio data mixing aimed at the bus management, the aim of the mixing by the mixing processor 1225 is not limited to the bus management.

Examples of the mixing aimed at other than the bus management include a case where for the purpose of localizing a virtual speaker in a position between speakers corresponding to adjoining two channels, the pieces of audio data thereof are mixed with an appropriate level ratio and delay. In such a case, the high-pass filter 1223 and the low-pass filter 1226 are not always necessary.

Moreover, in the above-described embodiments, the difference in delay time between the transmission path of the mixed audio data and the transmission path of the unmixed audio data is brought about by whether a radio data communication path is included or not. The present invention is not limited in that regard, and is also applicable, for example, to a case where although these both include a radio data communication path, since the types thereof are different, there is a difference in transmission speed and this causes a difference in delay time.

Further, the present invention is also applicable to a case where although the types or the like of the transmission path are the same, since processors accompanied by different delay times are disposed on one transmission path and on the other transmission path, the pieces of audio data transmitted on the transmission paths are accompanied by different time delays.

While the above-described embodiments are described by using as an example a case where 2.1 channel acoustic contents are played back by using a 2.1 channel speaker system, the present invention is also applicable to a case where acoustic contents of any number of channels are played back with a speaker system of any number of channels as long as the number of channels is more than one.

While in the above-described embodiments, acoustic data transmission conforming to the HDMI standard is performed from the player to the audio data processing device, any other DIR (Digital Audio Interface Receiver) may be adopted as the receiver of the audio data processing device. Moreover, when the player outputs analog audio data, a structure may be adopted in which the audio data processing device is provided with an AD converter and after converting the audio data input from the player into digital data, passes it to the DSPs.

The above-described embodiments and modifications will be summarized below.

An audio data processing device is provided with: a first input unit that receives input of first audio data representative of a first sound; a second input unit that receives input of second audio data representative of a second sound; a mixing unit that generates mixed audio data where the first audio data or audio data generated by using the first audio data is mixed with the second data or audio data generated by using the second audio data; a first output unit that outputs, to a first speaker, audio data being the first audio data or the audio data generated by using the first audio data and not having undergone the mixing by the mixing unit; a second output unit that outputs, to a second speaker, audio data having undergone the mixing by the mixing unit; a processor that is provided downstream of a point of branching of the audio data input to the mixing unit and upstream of the first output unit, or downstream of the mixing unit and upstream of the second output unit, and performs predetermined processing of adding an acoustic effect to the audio data; and a delay unit that is provided downstream of the point of branching of the audio data input to the mixing unit and upstream of the first output unit or downstream of the mixing unit and upstream of the second output unit, and delays the audio data so that a relationship of timing between input, to the first speaker, of the audio data output from the first output unit and input, to the second speaker, of the audio data output from the second output unit coincides with a relationship of timing of input between the first audio data at the first input unit and the second audio data at the second input unit.

According to the above-described audio data processing device, even when the times required until the audio data having undergone the mixing processing and the audio data not having undergone the mixing processing are input to the speakers on the downstream side of the mixing point are different, the timing gap when those sounds are emitted is avoided by the delay processing by the delay unit. In that case, at least part of the time required for the acoustic effect addition processing performed on at least one of the audio data having undergone the mixing and the audio data not having undergone the mixing on the downstream side of the mixing point and at least part of the time required until those pieces of audio data are input to the speakers on the downstream side of the mixing point are offset, as a result of which the overall delay of the system is reduced.

Moreover, in the above-described audio data processing device, a structure may be adopted in which the transmission speed of the audio data output from the second output unit is lower than the transmission speed of the audio data output from the first output unit and the processor is provided downstream of the point of branching of the audio data input to the mixing unit and upstream of the first output unit.

Further, in such an audio data processing device, a structure may be adopted in which the second output unit outputs the audio data by radio.

Alternatively, in the above-described audio data processing device, a structure may be adopted in which the transmission speed of the audio data output from the first output unit is lower than the transmission speed of the audio data output from the second output unit and the processing unit is provided downstream of the mixing unit and upstream of the second output unit.

Further, in such an audio data processing device, a structure may be adopted in which the first output unit outputs the audio data by radio.

According to those audio data processing devices, since the delay time required until the audio data output from one output unit is input to the speaker and the time required for the acoustic effect addition processing performed on the audio data output from the other output unit are offset, the overall delay of the system is reduced.

While the present invention has been described in detail with reference to specific embodiments, it is obvious to one of ordinary skill in the art that various changes and modifications are possible without departing from the spirit and scope of the present invention.

The present application is based upon Japanese Patent Application (No. 2012-069628) filed on Mar. 26, 2012, the contents of which are incorporated herein by reference.

INDUSTRIAL APPLICABILITY

According to the audio data processing device of the present disclosure, the sound timing gap between channels that is caused when pieces of audio data of a plurality of channels are transmitted through transmission paths of different transmission speeds can be eliminated and the delay of the time from audio data input to sound emission can be reduced. As a result, a sound field causing the listener little discomfort can be provided.

DESCRIPTION OF REFERENCE NUMERALS AND SIGNS

1 AV system
2 AV system
9 Sound system
11 Player
12 Audio data processing device
13 Lsp
14 Rsp
15 SW
16 Display

21 Player
22 Audio data processing device
91 Player
92 Audio data processing device
121 HDMI receiver
122 DSPs
123 DA converter
124 Amplifier
125 Transmitter
129 Controller
151 Receiver
152 DA converter
153 Amplifier
211 Delay time data receiver
212 Lip-sync processor
221 HDMI transmitter
1221 Decoder
1222 Processor
1223 High-pass filter
1224 Delay unit
1225 Mixing processor
1226 Low-pass filter
1227 Delay unit

The invention claimed is:

1. An audio data processing device comprising:

a first input unit that receives input of first audio data representative of a first sound;

a second input unit that receives input of second audio data representative of a second sound;

a mixing unit that mixes the first audio data and the second audio data to generate mixed audio data;

a first output unit that outputs, to a first speaker, audio data being the first audio data and not having undergone the mixing by the mixing unit;

a second output unit that outputs, to a second speaker, the mixed audio data generated by the mixing unit;

a processor that is provided between a point of branching to the mixing unit and the first output unit on a transmission path between the first input unit and the first output unit, or between the mixing unit and the second output unit, and performs processing of adding an acoustic effect to the audio data; and a delay unit that is provided between the branching point and the first output unit on the transmission path between the first input unit and the first output unit, or between the mixing unit and the second output unit, and delays the audio data so that a relationship of timing between input, to the first speaker, of the audio data output from the first output unit and input, to the second speaker, of the audio data output from the second output unit coincides with a relationship of timing of input between the first audio data at the first input unit and the second audio data at the second input unit, wherein a transmission speed of an audio data transmission path from the second output unit to the second speaker is lower than a transmission speed of an audio data transmission path from the first output unit to the first speaker, and the processor is provided between the branching point and the first output unit on the transmission path between the first input unit and the first output unit.

2. The audio data processing device according to claim 1, further comprising:

a third output unit that outputs, to a third speaker, audio data being the second audio data and not having undergone the mixing by the mixing unit;

an other processor that is provided between an other point of branching to the mixing unit and the third output unit on a transmission path between the second input unit and the third output unit, and performs processing of adding an acoustic effect to the audio data; and an other delay unit that is provided between the other branching point between the second input unit and the third output unit, and the third output unit, and delays the audio data so that a relationship of timing between input, to the third speaker, of the audio data output from the third output unit and input, to the second speaker, of the audio data output from the second output unit coincides with the relationship of timing of input between the first audio data at the first input unit and the second audio data at the second input unit.

3. The audio data processing device according to claim 1, wherein the audio data transmission path from the second output unit to the second speaker is a radio transmission path.

4. The audio data processing device according to claim 1, wherein a transmission speed of an audio data transmission path from the first output unit to the first speaker is lower than a transmission speed of an audio data transmission path from the second output unit and the second speaker, and the processor is provided between the mixing unit and the second output unit.

5. The audio data processing device according to claim 4, wherein the audio data transmission path from the first output unit to the first speaker is a radio transmission path.

6. The audio data processing device according to claim 1, wherein when processing contents of the processor are changed, a delay time set for the delay unit is changed based on a processing time required for the processing of the changed processing contents.

7. An audio data processing method comprising:

a first reception step of receiving input of first audio data representative of a first sound by a first input unit;

a second reception step of receiving input of second audio data representative of a second sound by a second input unit;

a mixing step of mixing the first audio data and the second audio data by a mixing unit to generate mixed audio data;

a first output step of outputting audio data being the first audio data and not having undergone the mixing, to a first speaker by a first output unit;

a second output step of outputting the mixed audio data generated by the mixing step, to a second speaker by a second output unit;

a processing step of performing processing of adding an acoustic effect to the audio data by a processor provided between a point of branching to the mixing unit and the first output unit on a transmission path between the first input unit and the first output unit, or between the mixing unit and the second output unit; and a delay step of delaying the audio data so that a relationship of timing between input, to the first speaker, of the audio data output from the first output unit and input, to the second speaker, of the audio data output from the second output unit coincides with a relationship of timing of input between the first audio data at the first input unit and the second audio data at the second input unit, by a delay unit provided between the branching point and the first output unit on the transmission path between the first input unit and the first output unit, or between the mixing unit and the second output unit, wherein a transmission speed of an audio data transmission path from the second output unit to the second speaker is lower than a transmission speed of an audio data transmission path from the first output unit to the first speaker, and the processor is provided between the branching point and the first output unit on the transmission path between the first input unit and the first output unit.

8. The audio data processing method according to claim 7, further comprising:

a third output step of outputting audio data being the second audio data and not having undergone the mixing by the mixing unit, to a third speaker by a third output unit;

a processing step of performing processing of adding an acoustic effect to the audio data by an other processor provided between an other point of branching to the mixing unit and the third output unit on a transmission path between the second input unit and the third output unit; and a delay step of delaying the audio data so that a relationship of timing between input, to the third speaker, of the audio data output from the third output unit and input, to the second speaker, of the audio data output from the second output unit coincides with the relationship of timing of input between the first audio data at the first input unit and the second audio data at the second input unit, by an other delay unit provided between the other branching point between the second input unit and the third output unit, and the third output unit.

9. The audio data processing method according to claim 7, wherein the audio data transmission path from the second output unit to the second speaker is a radio transmission path.

10. The audio data processing method according to claim 7, wherein a transmission speed of an audio data transmission path from the first output unit to the first speaker is lower than a transmission speed of an audio data transmission path from the second output unit and the second speaker, and the processor is provided between the mixing unit and the second output unit.

11. The audio data processing method according to claim 10, wherein the audio data transmission path from the first output unit to the first speaker is a radio transmission path.

12. The audio data processing method according to claim 7, wherein when processing contents of the processor are changed, a delay time set for the delay unit is changed based on a processing time required for the processing of the changed processing contents.

* * * * *